United States Patent [19]

Kohmura et al.

[11] Patent Number: 4,892,812

[45] Date of Patent: Jan. 9, 1990

[54] SILVER HALIDE PHOTOSENSITIVE MATERIALS

[75] Inventors: Isao Kohmura; Katsuaki Iwaosa, both of Nagaokakyo, Japan

[73] Assignee: Mitsubishi Paper Mills, Ltd., Tokyo, Japan

[21] Appl. No.: 924,169

[22] Filed: Oct. 27, 1986

Related U.S. Application Data

[62] Division of Ser. No. 575,998, Feb. 1, 1984.

[30] Foreign Application Priority Data

| | | | |
|---|---|---|---|
| Feb. 4, 1983 | [JP] | Japan | 58-16094 |
| Feb. 4, 1983 | [JP] | Japan | 58-16095 |
| Feb. 25, 1983 | [JP] | Japan | 58-31413 |
| Feb. 25, 1983 | [JP] | Japan | 58-31414 |
| Feb. 25, 1983 | [JP] | Japan | 58-31415 |
| Feb. 28, 1983 | [JP] | Japan | 58-33600 |
| Mar. 29, 1983 | [JP] | Japan | 58-54535 |
| Mar. 29, 1983 | [JP] | Japan | 58-54536 |

[51] Int. Cl.[4] ..... G03C 1/34; G03C 1/36

[52] U.S. Cl. ..... 430/567; 430/606; 430/611; 430/613; 430/614; 430/615; 430/520; 430/522; 430/949

[58] Field of Search ..... 430/606, 611, 613, 614, 430/615, 949, 567, 520, 522

[56] References Cited

U.S. PATENT DOCUMENTS

| | | | |
|---|---|---|---|
| 2,377,375 | 6/1945 | Russell | 430/611 |
| 2,476,536 | 11/1947 | Dersch | 430/611 |
| 3,026,201 | 3/1962 | Rauch et al. | 430/611 |
| 3,326,687 | 6/1967 | Kalenda | 430/606 |
| 3,362,826 | 1/1968 | Weyde et al. | 430/611 |
| 3,418,131 | 12/1968 | Bigelow | 430/611 |
| 3,600,167 | 8/1971 | Judd et al. | 430/567 |
| 3,628,958 | 3/1970 | Haefner | 430/606 |
| 4,115,126 | 9/1978 | Whitney | 430/520 |
| 4,472,497 | 9/1984 | Kitchin | 430/606 |
| 4,666,827 | 5/1987 | Sumi et al. | 430/567 |

FOREIGN PATENT DOCUMENTS

| | | |
|---|---|---|
| 125734 | 10/1981 | Japan . |
| 149030 | 11/1981 | Japan . |
| 946476 | 1/1964 | United Kingdom . |

*Primary Examiner*—Paul R. Michl
*Assistant Examiner*—Mark R. Buscher
*Attorney, Agent, or Firm*—Cushman, Darby & Cushman

[57] ABSTRACT

There is disclosed a silver halide photosensitive material for use under room-light wherein at least one silver halide emulsion layer contains (1) a spectrally unsensitized negative silver halide having an average grain size of 0.1 to 0.3 μm and containing at least 80 mol % of silver chloride and (2) an organic desensitizer having an anodic polarographic potential and a cathodic polarographic potential which give a positive sum and this photosensitive material satisfying at least one of the following requirements:

(a) said emulsion has undergone substantially no chemical ripening;

(b) a spectrally non-sensitizing dye capable of absorbing chiefly the rays in the range of from about 500 to 600 nm is contained in at least one of said photographic layers; and (c) at least one of the compounds from (i) to (v) as disclosed in the specification is contained in said emulsion layer.

4 Claims, No Drawings

SILVER HALIDE PHOTOSENSITIVE MATERIALS

This is a division of Ser. No. 575,998, filed Feb. 1, 1989.

BACKGROUND OF THE INVENTION

This invention relates to a silver halide photosensitive material and a process for the production thereof. More particularly, it relates to a photosensitive material for room-light.

In recent years in the field of graphic arts an improvement of efficiency in the reproduction working process is requested to cope with the complexity of prints and the progress of a scanner. In order to comply with the request an extremely low-sensitivity photographic film having a sensitivity as low as about $10^{-3}$ to $10^{-5}$ times that of a conventionally used contact negative film has already been developed and begun to be used as a reproduction film capable of being treated under UV-free room-light, namely, as a photosensitive material for use under room-light. The performance characteristic required for such a photosensitive material for use in room-light include a high contrast with a sufficiently high maximum density, tolerance for a long-lasting treatment under room-light, and a high sensitivity to a printer light source. The conventional photosensitive materials for use under room-light, however, are hardly said to meet sufficiently the above requirements and there is a demand for the development of more improved photosensitive material for use under room-light.

The silver halide emulsion for photosensitive materials suitable for use under room-light may be produced by the method described in Japanese Patent Application "Kokai" (Laid-open) No. 125,734/81, which employs as an inorganic desensitizer a large amount of rhodium salt in a silver halide emulsion containing silver chloride as major component, or by the method which employs an organic desensitizer usually used in a direct-positive silver halide emulsion, such as Pinacryptol Yellow. The present inventors found, however, that the emulsion produced by either method has an essential disadvantage as a room-light photosensitive material in that it gives only an insufficient guarantee for the safe treatment under room-light. The emulsion containing a rhodium salt is subject to considerable fogging under room-light, while the emulsion containing an organic desensitizer suffers from considerable decline in sensitivity when an imagewise exposed emulsion is left standing under room-light even for a short period of time before development, though the emulsion is treatable under room-light without fogging for an extended period of time. Although it is, of course, possible in the latter case to avoid the decline in sensitivity by developing the emulsion immediately after the imagewise exposure, still the safety for the treatment under room-light is requested to be improved, because the emulsion is frequently left standing under room-light when a large number of photographic materials are successively exposed or for other reasons.

SUMMARY OF THE INVENTION

The object of this invention, therefore, to provide an improved silver halide photosensitive material for use under room-light by eliminating the aforesaid disadvantage of conventional photosensitive materials for use under room-light containing organic desensitizers as well as to provide a process for the production of such photosensitive materials.

DESCRIPTION OF THE INVENTION

The present inventors found, as a result of an extensive study, that it is possible to achieve the above object by providing a photographic material comprising a support and photographic layers including at least one silver halide emulsion layer which is characterized in that said emulsion layer comprises (1) spectrally unsensitized negative silver halide having an average grain size of 0.1 to 0.3 μm and containing 80 mole-% or more of silver chloride and (2) an organic desensitizer having an anodic polarographic potential and a cathodic polarographic potential which give a positive sum, and said photosensitive material meets at least one of the following requirements:

(a) said emulsion has undergone substantially no chemical ripening;

(b) a spectrally non-sensitizing dye capable of absorbing chiefly the rays in the range of from about 500 to 600 nm is contained in at least one of said photographic layers; and (c) at least one of the following compounds from (i) to (v) is present in said emulsion layer;

(i) compounds of the general formula (A)

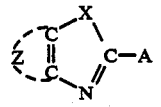

(A)

wherein Z represents a group of carbon atoms necessary for forming a benzene or naphthalene ring which may have a substituent, X represents sulfur atom, selenium atom, oxygen atom, NH, or N-R, R being an alkyl group, A represents a monovalent group bonded to the carbon atom at the position 2 through a carbon atom, sulfur atom, or oxygen atom, and the ring formed by Z may have a substituent provided that any of the substituents present in the general formula (A) does not contain nitro group, sulfo group, or carboxyl group;

(ii) compounds of the general formula (B)

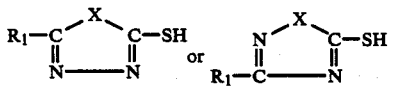

(B)

wherein X represents sulfur atom, selenium atom, oxygen atom, or N-$R_2$ group, $R_2$ represents a lower alkyl group having preferably 1 to 4 carbon atoms, allyl group, or amino group, $R_1$ represents hydrogen atom, a halogen atom, or a monovalent group (such as, for example, substituted or unsubstituted alkyl group, allyl group, aryl group, thiol group, alkylthio group, arylthio group, aralkylthio group, amidinothio group, hydroxyl group, alkoxy group, aryloxy group, or amino group) which is bonded to the carbon atom at the position 5 through carbon atom, sulfur atom, oxygen atom, or nitrogen atom, and the compound of general formula B does not have a nitro group, sulfo group, or carboxyl group;

(iii) heterocyclic compounds having a group bonded through a nitrogen atom to the carbon atom adjacent to the nitrogen atom in the ring;

(iv) 2-mercaptobenzoic acids; and (v) $10^{-8}-10^{-5}$ mole of a water-soluble rhodium salt per mole of silver halide.

The heterocyclic compounds (iii) are preferably those represented by the general formula (C) or (D):

(C)

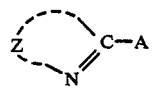

(D)

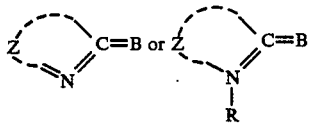

wherein Z represents the remaining group of atoms necessary for forming a five- or six-membered nitrogen-containing heterocyclic ring; A represents a group such as a substituted or unsubstituted amino group (for example, amino group, methylamino group, hydroxyamino group, acetamido group, hydrazino group, ureido group, amidinoamino group, guanidino, etc.) capable of forming a >C—NH— linkage; B represents a group such as a substituted or unsubstituted imino group (for example, imino group, hydrazo group, or hydroxyimino group) capable of forming a >C=N— linkage; R represents a hydrogen atom, alkyl group having preferably 1 to 5 carbon atoms, aryl group, aralkyl group, or allyl group; and the compound of the general formula (C) or (D) does not have a sulfo group, carboxyl group, or nitro group.

The invention is described below in detail.

The organic desensitizers employed according to this invention are those generally known to be used in direct-positive silver halide emulsions. Such organic desensitizers are characterized by their polarographic half-wave potentials, that is, the oxidation reduction potentials determined by polarography. Those useful for the practice of this invention have an anodic polarographic potential and a cathodic polarographic potential which, when added together, give a positive sum. The determination of oxidation reduction potential can be made by the method described in U.S. Pat. No. 3,501,307. Examples of individual organic desensitizers are described in many patent documents and other literature. They exhibit each the same effect when used in the practice of this invention and include those described, for example, in Japanese Patent Publication Nos. 17,595/61, 20,261/64, 26,751/65, 13,167/68, 8,833/70, 8,746/72, 10,197/72, and 3,753/75; Japanese Patent Application "Kokai" (Laid-open) Nos. 24,734/73, 84,639/74, and 142,525/81; U.S. Pat. Nos. 2,271,229, 2,541,472, 3,035,917, 3,062,651, 3,124,458, 3,326,687, and 3,671,254. The examples include the following compounds:

D-1 : 1,3-Diethyl-1'-methyl-2'-phenylimidazo[4,5-b]quinoxalino-3'-indolocarbocyanine iodide.

D-2 : Pinacryptol Yellow.

D-3 : 1,1',3,3,3',3'-Hexamethyl-5,5'-dinitroindocarbocyanine p-toluenesulfonate.

D-4 : 5,5-Dichloro-3,3'-diethyl-6,6'-dinitrothiacarbocyanine iodide.

D-5 : 1,1'-Dimethyl-2,2'-diphenyl-3,3'-indolocarbocyanine bromide.

D-6 ': 1,1',3,3'-tetraethylimidazo[4,5-b]quinoxalinocarbocyanine chloride.

D-7 : 5-m-Nitrobenzylidenerhodanine.

D-8 : 6-Chloro-4-nitronitrobenzotriazole.

D-9 : 1,1'-Dibutyl-4,4'-bipyridinium dibromide.

D-10 : 1,1'-Ethylene-2,2'-bipyridinium dibromide.

D-11 : 4-(p-n-Amyloxyphenyl)-2,6-di(p-ethylphenyl)-thiapyrylium perchlorate.

D-12 ': 2-Mercapto-4-methyl-5-nitrothiazole

D-13 : 2-(o-Nitrostyryl)-3-ethylbenzothiazolium toluenesulfonate.

D-14 : 2-(p-Nitrostyryl)quinoline p-toluenesulfonate.

D-15 : Phenosafranine.

D-16 : Pinacryptol Green.

D-17 : 2,3-Dimethyl-6-nitrobenzothiazolium p-toluenesulfonate.

The amount to be used of the organic desensitizer is selected from the range of from 50 mg to 5 g, preferably from 100 mg to 3 g, per 1 mole of silver halide. The desensitizer is added to the emulsion generally after completion of ripening, though not exclusively.

The silver halide emulsion used in the practice of this invention is a negative-type emulsion containing at least 80 mole-% of silver chloride. As distinguished from a direct-positive silver halide emulsion, the negative-type emulsion is an unfogged silver halide emulsion of the common type capable of forming a negative image from a positive original. The silver halide emulsion contains preferably at least 90 mol% of silver chloride. An emulsion containing less than 80 mole-% of silver chloride is unsuitable for the purpose of this invention. The emulsion may contain, if necessary, a slightest amount, e.g. 0.2 mole-%, of silver iodide, though its complete absence is preferred.

The silver halide emulsion according to this invention contains fine grains of silver halides, the average size being 0.1 to 0.3 μm. It is desirable that 90% or more of the grains have a size within ±10% of the average value. The preparation of the silver halide emulsion may be carried out in any of the known ways such as mixing of the components in normal or reverse order or simultaneous mixing. According to the common practice of emulsion manufacture, the emulsified mixture is subjected successively to physical ripening, desalting, and after-ripening to effect chemical sensitization. The present inventors, however, found that one of the effective means to prevent the emulsion from the aforementioned decline of sensitivity under room-light is to omit the step of chemical sensitization. The common chemical sensitization comprises addition of a sulphur sensitizer, reduction sensitizer, noble metal sensitizer or the use of an active gelatin containing a sulfur compound, and succeeding ripening at a prescribed temperature and pH for an extended period of time. According to this invention, the chemical sensitization in this sense is omitted, except for the slight sensitization caused by the trace amounts of sensitizing substances contained in a common inactive gelatin.

The silver halide emulsion according to this invention is not spectrally sensitized. As is well known to the art, the spectral sensitization is a means to impart sensitivity to the rays in a range of wavelengths longer than those in the sensitivity range characteristic of silver halides. It is performed by the addition of cyanine, merocyanine or other dyes to effect optical sensitization. It is also well known to the art to use in the photographic material having a spectrally sensitized silver halide emulsion layer a dye exhibiting an absorption in the optically sensitized range (particularly the maximum sensitivity wavelengths) for the purpose of preventing the photographic material from halation or irradiation. In other words, such a dye is usually unnecessary for the photographic material having a spectrally unsensitized silver halide emulsion layer.

According to another embodiment of this invention, the aforementioned decline in sensitivity after the imagewise exposure of a photographic material having a spectrally unsensitized silver halide emulsion layer can be avoided by incorporating in the emulsion layer or at least one of the other photographic layers disposed on the emulsion layer of said photographic material a dye capable of absorbing chiefly the rays in the wavelength range of from about 500 to about 600 nm, preferably a dye exhibiting in said layer a maximum absorption in said wavelength range. The wavelength range of from 500 to 600 nm is not a strict one, but a dye having sufficient absorption in said range can be used even though the wavelengths of maximum absorption are not strictly in said range. In order to achieve the maximum effect with a small amount of dye, it is preferable to use a dye having maximum absorption wavelengths in the range of from 500 nm to 580 nm. Although depending on various factors associated with particular silver halide emulsion, the most preferable maximum absorption wavelengths can easily be determined by a simple experiment. Such a dye can be added to the silver halide emulsion layer, or preferably in other photographic layers, such as a protective layer, which are situated more apart from the support than the emulsion layer in order to enhance the effectiveness of the dye. It can also be included in the protective layer and/or the undercoat layer.

In the present specification, the words "photographic layer" include protecting layer, undercoat layer and the like as well as silver halide emulsion layer.

The amount of applied dyes is about 5 mg to about 1 g per square meter, preferably 0.3 or more in terms of optical density (reflection or transmission density) at the maximum absorption wavelength. The upper limit of the amount of dye is not specifically limited, because it depends on the extent of the aforementioned decline in sensitivity and the decoloring tendency of the dye.

The dye suitable for use according to this invention can be selected from a wide variety of types. Desirable dyes are those having in the molecule preferably two or more sulfo groups or carboxyl groups. The dyes used in this invention are any of those which may exhibit in the coating layers absorption of rays chiefly in the wavelength range of from about 500 to about 600 nm. Such a dye is selected from the oxazole, azo, xanthene, cyanine, triphenylmethane, styryl, merocyanine, anthraquinone, and indophenol dyes described, for example, in U.S. Pat. Nos. 2,274,782, 2,527,583, 2,533,472, 2,464,785, 2,611,125, 2,598,660, 3,005,711, 2,494,032, 2,956,879, 3,282,699, 3,615,608, and 3,840,375; Brit. Patent Nos. 1,253,933, and 1,338,799; West German Patent Application Laid-open (Offenlegungsschrift) Nos. 2,026,252, 2,127,327, 2,321,470, and 2,347,590; Japanese Patent Application "Kokai" (Laid-open) Nos. 17,322/73, 85,130/73, 114,420/74, 23,221/75, 28,827/75, 115,815/75, 10,927/76, 77,327/76, 29,727/77, 65,426/77, 108,115/77, 11,717/77, 128,125/77, 29,804/80, 33,103/80, 33,104/80, 46,752/80, 88,047/80, 155,350/80, 161,232/80, 161,234/80, and 120,660/80.

Typical but nonlimitative Examples of suitable dyes are shown below.

Dye 1

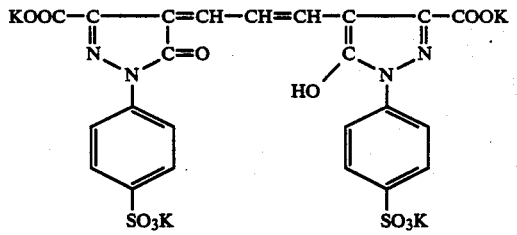

Dye 3

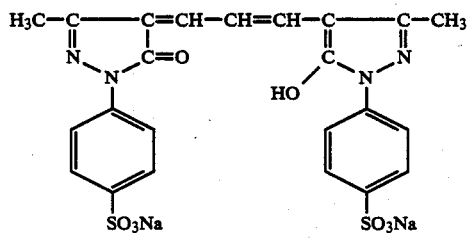

Dye 3

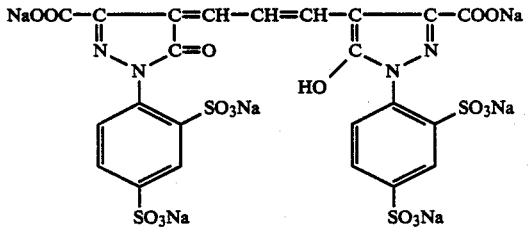

Dye 4

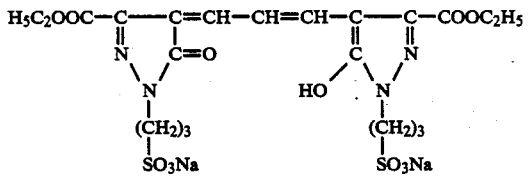

Dye 5

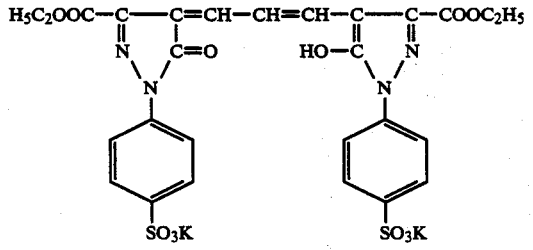

Dye 6
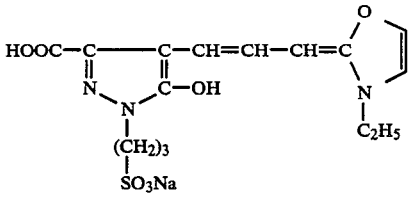
Dye 7
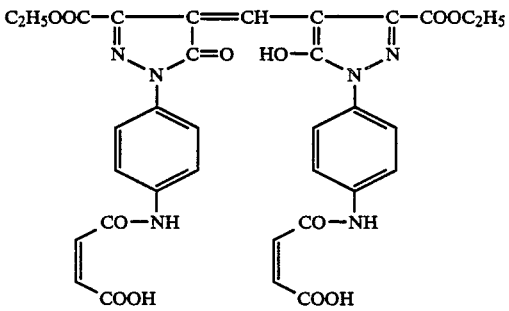
Dye 8
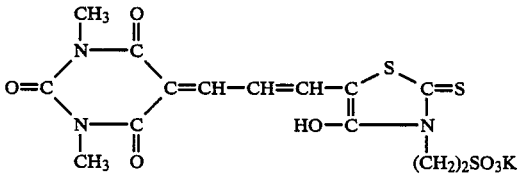
Dye 9
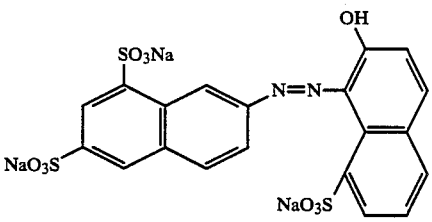
Dye 10
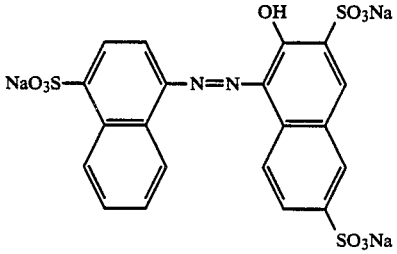
Dye 11
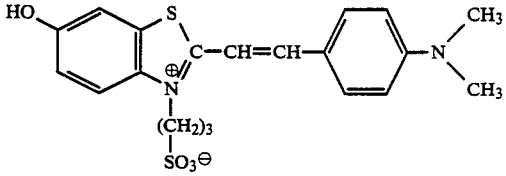
Dye 12
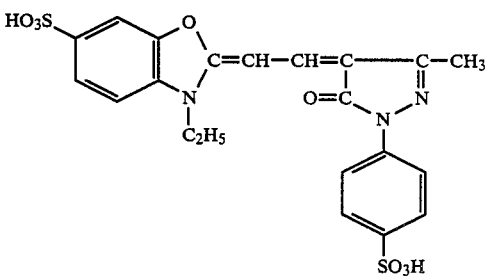
Dye 13
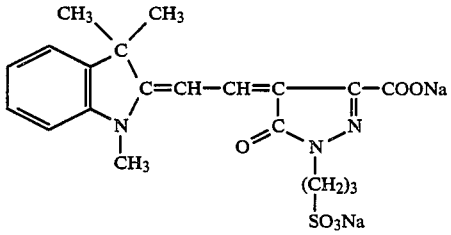
Dye 14
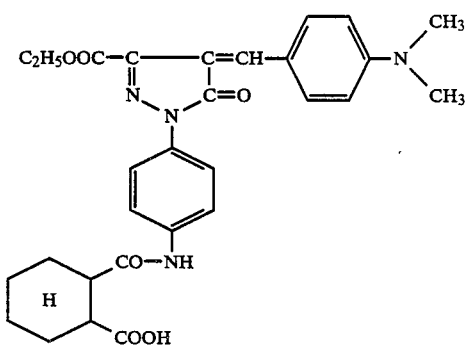

Dye 15

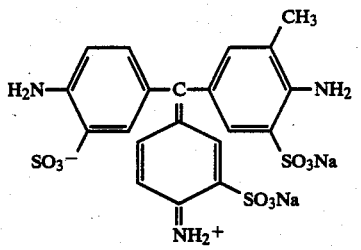

Dye 16

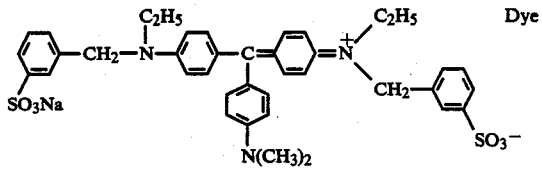

Dye 17

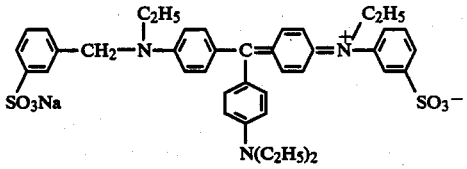

According to still another embodiment of this invention, it was found that the aforementioned decline in sensitivity under room-light can be avoided by incorporating in the emulsion layer one of the compounds described previously in (i) to (v). In the general formula (A), the substituent groups attached to the benzene ring include alkyl groups (preferably of 1 to 5 carbon atoms), alkoxy groups (preferably of 1 to 5 carbon atoms), amino groups, halogen atoms, etc; R is an alkyl group having preferably 1 to 5 carbon atoms. As examples of A, mention may be made of unsubstituted alkyl groups (preferably of 1 to 5 carbon atoms), substituted (for example, by a hydroxyl group, alkoxy group, amino group, aryl group, or heterocyclic group, halogen atom, etc.) alkyl groups, allyl group, aryl groups, thiol groups, alkylthio groups, allylthio groups, arylthio groups, aralkylthio groups, amidinothio groups, hydroxyl group, alkoxythio group, aryloxy group, heterocyclic groups, etc.

Examples of compounds of the general formula (A):

(1)

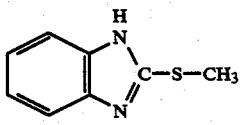

(2)

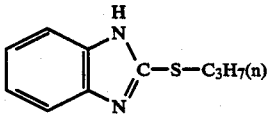

-continued (3)

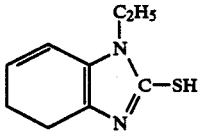

(4)

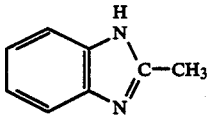

(5)

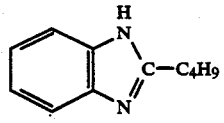

(6)

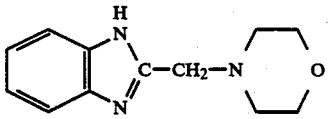

(7)

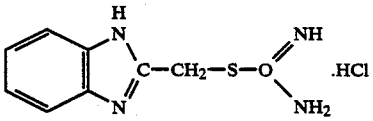

(8)

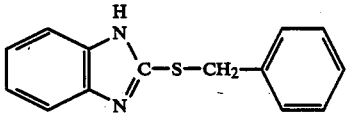

(9)

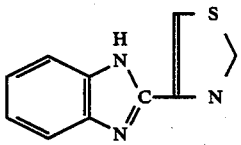

(10)

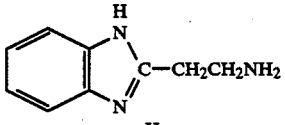

(11)

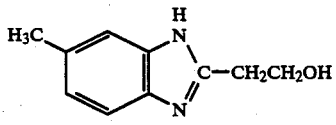

(12)

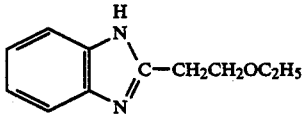

(13)

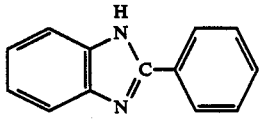

(14)

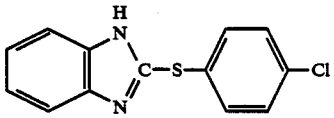

-continued
(15)
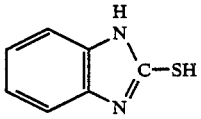
(16)
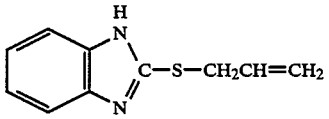
(17)
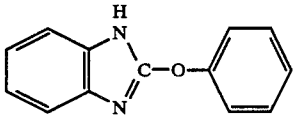
(18)
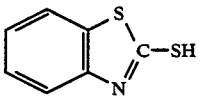
(19)
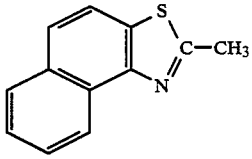
(20)
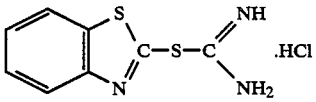
(21)
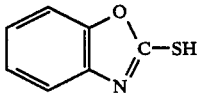
(22)
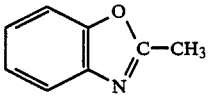
(23)
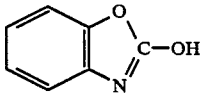
(24)
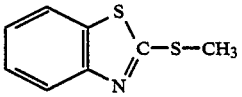
Examples of compounds of the general formula (B):
(25)
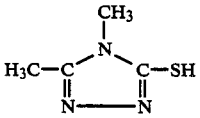
(26)
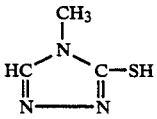
-continued
(27)
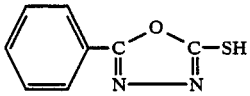
(28)
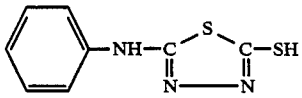
(29)
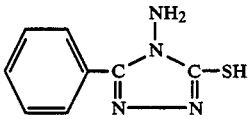
(30)
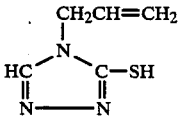
(31)
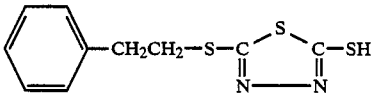
(32)
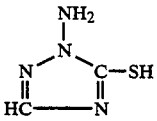
Examples of compounds of the general formulas (C) and (D):
(33)
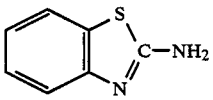
(34)
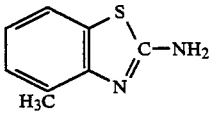
(35)
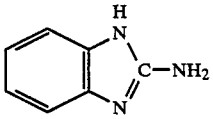
(36)
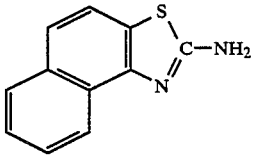
(37)
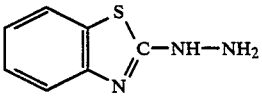
(38)
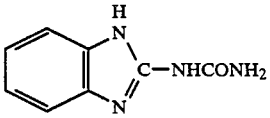

-continued (39)

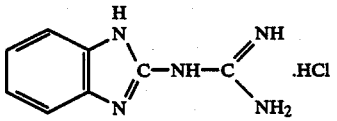

(40)

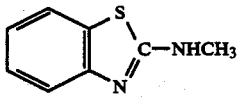

(41)

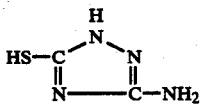

(42)

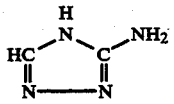

(43)

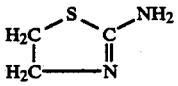

(44)

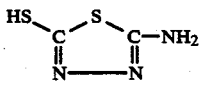

(45)

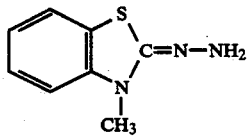

(46)

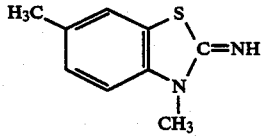

(47)

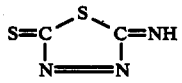

(48)

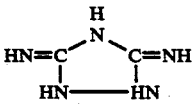

As examples of 2-mercaptobenzoic acids mention may be made of thiosalicylic acid, thiosalicylic acid substituted by an alkyl, alkoxy, amino, or acylamino group, a halogen atom, etc. and thiosalicylic acid protected so as to form a mercapto group, such as S-acetylthiosalicylic acid, S-methylcarbamoylthiosalicylic acid, S-phenylcarbamoylthiosalicylic acid, or S-ethoxycarbonylthiosalicylic acid. These thiosalicylic acids are known compounds described, for example, in Japanese Patent Application "Kokai" (Laid-open) No. 8,145/81. The compounds described previously in (i) to (iv) can be added to the silver halide emulsion as a solution in water or an organic solvent miscible with water, or a mixture thereof. It is also possible to add the compound to the coating liquor to form a layer adjacent to the emulsion layer and to allow the compound to diffuse into the emulsion layer. The compound can be added at any time during preparation of the emulsion. The amount to be added is generally about 20 mg to about 5 g per mole of silver halide. If necessary, antifoggants and stabilizers may be added in addition to the above compound.

Compounds used as reference are as shown below.

(A)

(A)

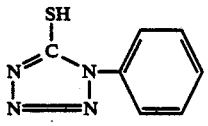

(B)

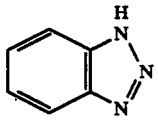

(C)

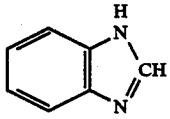

(D)

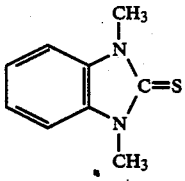

(E)

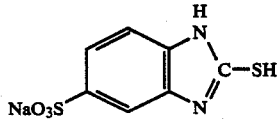

(F)

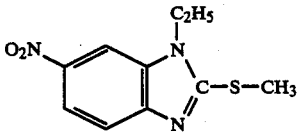

(G)

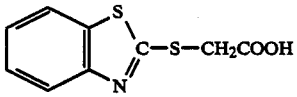

(H)

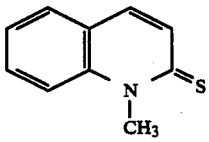

(I)

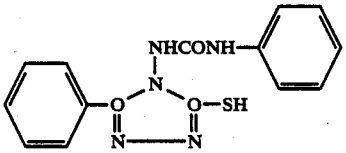

(J)

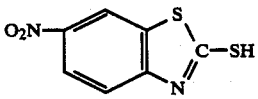

-continued

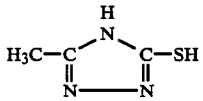

(K)

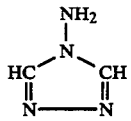

(L)

The water-soluble rhodium salts described in (V) are known compounds including, as representatives, rhodium monochloride, rhodium dichloride, rhodium trichloride, and rhodium ammonium chloride. The rhodium salt is added preferably at the stage of silver halide precipitation or during the period of physical ripening, though it can be added in subsequent stages. Japanese Patent Application "Kokai" (Laid-open) No. 125,734/81 discloses an emulsion containing a rhodium salt in a large amount. The photographic material having the layer of such an emulsion becomes markedly fogged when treated under room-light for an extended period of time. If the amount of a rhodium salt is reduced, the resulting increase in sensitivity is accompanied with also the problem of fogging and the soft gradation.

The present inventors found that by the use of a combination of an organic desensitizer as major component and a minute amount of a rhodium salt, it is possible to obtain a photographic material which is remarkably increased in the safety of processing under room-light and which gives a high-contrast image. If use is made of a combination of an organic desensitizer with a large amount of rhodium salt, as described in the above Patent Application, there is obtained a photographic material which, as compared with the photographic material of this invention, shows softer gradation and a greater decrease in sensitivity when left standing under room-light after the imagewise exposure. The amount used of a rhodium salt is $10^{-5}$ to $10^{-8}$, preferably $5\times10^{-6}$ to $5\times10^{-8}$ mole per mole of silver halide.

The disadvantages which accompany the organic desensitizer are greatly removed by any of the means described previously in (a), (b) and (c). Especially preferred is a combination of the means (a) with at least one compound described in (c). The means described in (b) can attain deep coloration and is very effective so long as the dye does not remain in the photographic materials after developing treatment. The concentration of dye described in (b) can be reduced by combining the means (a) or/and (c) with the means (b). Especially preferred compounds described in (c) are a 2-mercaptobenzoic acid and a water-soluble rhodium salt. It is desirable to use a combination of $10^{-8}$ to $10^{-5}$ mole of a water-soluble rhodium salt per mole of silver halide and a compound represented by the general formula (I)

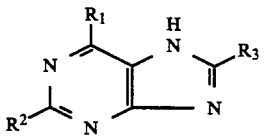

(I)

wherein $R_1$, $R_2$ and $R_3$ represent each a hydrogen atom, amino group, hydroxyl group, mercapto group, alkyl group, or aryl group. As the compounds of general formula (I), mention may be made of those described in Japanese Patent Application "Kokai" (Laid-open) No. 149,030/81. Typical examples are as shown in the following Table (shown in terms of $R_1$, $R_2$ and $R_3$).

| Compound No. | $R_1$ | $R_2$ | $R_3$ |
|---|---|---|---|
| 1 | $NH_2$ | H | H |
| 2 | OH | $NH_2$ | H |
| 3 | $NHCH_2C_6H_5$ | H | H |
| 4 | $NH_2$ | $NH_2$ | H |
| 5 | $NH_2$ | H | $CH_3$ |
| 6 | $NH_2$ | $CH_3$ | H |
| 7 | $NH_2$ | H | OH |
| 8 | $NH_2$ | $C_8H_{17}$ | SH |
| 9 | $NH_2$ | H | $NH_2$ |

These compounds can be added to the photographic emulsion at any stage of its preparation. Although depends on the stage of emulsion preparation, the amount used of the compound is preferably 20 mg to about 1,000 mg per mole of silver halide. An emulsion of satisfactory high-contrast characteristics is obtained not by the combination of the above compound with $10^{-5}$ mole or less of a rhodium salt per mole of silver halide, as is apparent from Japanese Patent Application "Kokai" No. 149,030/81, but by the combination with an organic desensitizer.

The silver halide photographic material according to this invention may contain those additives generally used in common photographic emulsions, such as stabilizers, antifoggants, covering power improving agents, film property improving agents, surface active agents, hardeners, matting agents, developing agents, etc. The emulsion is coated on a known support. Other hydrophilic colloid layers such as protective layer and undercoat may be applied.

The photographic material for use under room-light according to this invention is exposed to a light source rich in ultraviolet rays, which is used chiefly in printing field, such as, for example, mercury lamp, superhigh pressure mercury lamp, halide lamp, and the like.

The photographic material for use under room-light according to this invention can be handled safely under a bright room-light for an extended period of time either before or after the exposure to the said light source.

EXAMPLE 1

A silver chlorobromide emulsion containing 97 mole-% of silver chloride was prepared by the method of simultaneous mixing to obtain a monodisperse emulsion of 0.2 μm in average grain size. An inactive gelatin was used. To the resulting emulsion after desalting and redissolving, was added Pinacryptol Yellow (D-2), an organic desensitizer, in an amount of 500 mg per mole of silver halide, followed by a stabilizer, hardener, and surface active agent. The resulting emulsion was coated, together with a protective gelatin coating, on a polyester film base at a coverage of 5 g/m$^2$ in terms of silver nitrate, and dried. A test specimen from the coated film was given a sensitometric exposure using a printer with a 1.5 kW superhigh pressure mercury lamp. The exposed specimen was developed in D-85 developer at 20° C. for 2 minutes, then fixed and dried. The gradation gamma value (γ) was 4.4 and the fog density was 0.03. Another test specimen was exposed to about 500 lux room-light of free of ultraviolet rays, namely, under a fluorescent lamp FL 40SW NU (Toshiba), for 5 hours. The test specimen was then given a sensitometric exposure and developed in the same manner as described above. No change was observed in characteristics, that is, sensitivity, gradation, and fog. Another test specimen was sensitometrically exposed, then again exposed to the above UV-free room-light for 10 minutes, and developed. The sensitivity was 95% of the original value and no change was observed in gradation and fog.

For comparison, a reference emulsion was prepared by desalting the above emulsion, adding to the emulsion $5\times10^{-5}$ mole of sodium thiosulfate per mole of silver halide, and chemically ripening the emulsion at pH 6.0 and 55° C. for 30 minutes. Using the reference emulsion a test specimen was prepared in the same manner as described above. It showed a gamma value of 4.7 and a fog density of 0.05. The unexposed test specimen showed good stability to the above room-light, whereas after exposure it showed a sensitivity of 35% of the original value, as tested in the same manner as described above.

EXAMPLE 2

Test specimens were prepared in the same manner as in Example 1, except that 500 mg of an organic desensitizer (D-1), (D-5), (D-6), (D-7), (D-8), (D-9), (D-10), (D-13), or (D-17) was used in place of the Pinacryptol Yellow. Each specimen showed a gamma value of 4.2 to 4.7 and a fog density of 0.02 to 0.04. Upon testing the safety under the room-light in the same manner as in Example 1, no increase in fog density was observed and the decline in sensitivity was as small as 5 to 10%. A reference emulsion prepared by the same chemical ripening as in Example 1 was tested for the stability to the room-light after exposure in the same manner as in Example 1. It should a sensitivity of about 30 to about 45% of that of corresponding emulsion of this invention.

EXAMPLE 3

Precipitation of silver halide was carried out in a customary manner using $10^{-6}$ mole of rhodium chloride per mole of silver chlorobromide containing 95 mole-% of silver chloride. After physical ripening, a monodisperse emulsion of 0.2 μm in average grain size was obtained. To the resulting emulsion, after desalting and redissolving, was added Pinacryptol Yellow (D-2), an organic desensitizer, in an amount of 200 mg per mole of silver halide, followed by a stabilizer, hardener, and surface active agent. The resulting emulsion was coated, together with a protective gelatin coating, on a polyester film base at a coverage of 5 g/m$^2$ in terms of silver nitrate, and dried. A test specimen from the coated film was given a sensitometric exposure using a printer, then developed in D-85 developer for 2 minutes, fixed, and dried. The gradation gamma value (γ) was 5.5 and the fog density was 0.04. Another specimen was exposed for 5 hours to the room-light of about 500 lux and then sensitometrically exposed and developed in the same manner as described above. No change was observed in sensitivity, gradation, and fog. Another specimen was sensitometrically exposed, then again exposed for 15 minutes in the same room-light as described above and developed. The sensitivity was 90% of the original value and no change was observed in gradation and fog.

For comparison, a reference emulsion was prepared in the same manner as described above, except that $5\times10^{-4}$ mole of rhodium salt was used. A test specimen prepared by using the reference emulsion showed a gamma value of 3.3 and a fog density of 0.03. Another specimen was sensitometerically exposed and then exposed to the room-light. The sensitivity was reduced to 40% of the original value. A reference specimen prepared by using no rhodium salt showed a gamma value of 3.3 and a fog density of 0.04. Another specimen was sensitometrically exposed and then exposed to the room-light. The sensitivity declined to 80% of the original value.

EXAMPLE 4

Test specimens were prepared in the same manner as in Example 3, except that an organic desensitizer (D-1), (D-5), (D-6), (D-7), (D-8), (D-9), (D-10), (D-13), or (D-17) was used in an amount of 200 mg in place of the Pinacryptol Yellow. All test specimens showed a gamma value of 5.2 to 5.7 and a fog density of 0.03 to 0.04. The safety test under the room-light performed as in Example 3 showed no increase in fog density and a small decline of 5 to 15% in sensitivity.

EXAMPLE 5

Precipitation of silver halide was carried out in a customary manner using 100 mg of adenine and $10^{-6}$ mole of rhodium chloride per mole of silver chlorobromide containing 95 mole-% of silver chloride. After physical ripening, a monodisperse emulsion of 0.2 μm in average grain size was obtained. To the resulting emulsion, after desalting and redissolving, was added Pinacryptol Yellow (D-2), an organic desensitizer, in an amount of 500 mg per mole of silver halide, followed by a hardener and a surface active agent. The resulting emulsion was coated, together with a protective gelatin coating, on a polyester film base at a coverage of 5 g/m$^2$ in terms of silver nitrate, and dried (blank specimen).

The blank specimen was given a sensitometric exposure using a printer. The exposed specimen was developed in D-85 developer at 20° C. for 2 minutes, then fixed and dried. The gradation gamma value (γ) was 8.7 and the fog density was 0.02, indicating desirable characteristics.

The blank specimen was exposed to the room-light of about 500 lux for 3 hours. The specimen was then sensitometrically exposed and developed as described above. No change was observed in characteristics such as sensitivity, gradation, and fog. The emulsion used in the blank specimen was excellent, because it showed persistent stability under the room-light, in addition to high contrast and low fog. However, when the blank specimen was sensitometrically exposed, then left standing under said room-light for 30 minutes, and developed, the sensitivity was found declined to 12% of the original value.

Specimens were prepared in the same manner as that of preparing the blank specimen, except that 400 mg of thiosalicylic acid, a derivative thereof, or a reference compound per mole of silver halide was used. Each specimen was sensitometrically exposed, then left standing for 30 minutes under the room-light, and tested for sensitivity. The results were as shown in Table 1, wherein the sensitivity was expressed in terms of relative sensitivity, assuming that the sensitivity of each specimen which was not left standing under room-light is 100.

TABLE 1

| Specimen No. | Compound | Sensitivity |
|---|---|---|
| Blank | — | 12 |
| 1 | Thiosalicylic acid | 98 |
| 2 | 4-Aminothiosalicylic acid | 98 |
| 3 | S—Methylcarbamoyl-thiosalicylic acid | 96 |
| 4 | (A) | 22 |
| 5 | (M) | 7 |
| 6 | (G) | 8 |
| 7 | (N) | 10 |

The following compounds were used as reference.

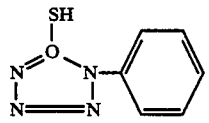
(A)

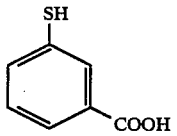
(M)

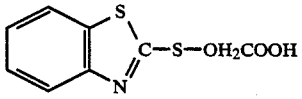
(G)

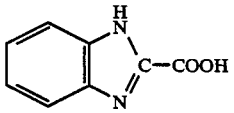
(N)

The results shown in Table 1 showed that thiosalicyclic acid compounds have markedly reduced the decline in sensitivity of the exposed specimen when left standing under room-light.

EXAMPLE 6

A monodisperse emulsion of 0.15 μm in average grain size was obtained by using $5\times10^{-7}$ mole of rhodium chloride per mole of silver chlorobromide containing 98 mole-% of silver chloride. The emulsion was treated in the same manner as in Example 5, except that combinations of organic sensitizers as shown in Table 2 were used.

TABLE 2

| | Blank | Thiosalicylic acid |
|---|---|---|
| D-2 | 10 | 98 |
| D-6 | 9 | 96 |
| D-7 | 5 | 96 |
| D-10 | 11 | 97 |
| D-12 | 8 | 96 |

From the results of sensitivity measurements shown in Table 2, it is seen that the decline of sensitivity of the imagewise exposed specimens containing an organic desensitizer caused by the leaving of the specimens under room-light can be mostly avoided by use of thiosalicylic acid or suitable derivatives thereof.

EXAMPLE 7

An emulsion of silver chlorobromide containing 87 mole-% of silver chloride was prepared by the method of simultaneous mixing. The resulting emulsion was monodisperse and the silver halide grains were cubic in form and 0.18 μm in average size. In a manner similar to that in Example 5, a blank specimen was prepared by using each 300 mg of organic desensitizers (D-10) and (D-12) per mole of silver halide. Similarly to the blank specimen of Example 5, the blank specimen obtained above showed a defect in that when left standing under room-light, the sensitivity of imagewise exposed specimen declines to 10% of the sensitivity determined immediately after the imagewise exposure.

To the emulsion used in the blank specimen, was added 600 mg of thiosalicylic acid, 5-amino-2-mercaptobenzoic acid, or 4-methoxy-2-mercaptobenzoic acid per mole of silver halide. Using the resulting emulsion, three types of specimens were prepared in a manner similar to that of preparing the blank specimen. It was confirmed that the decline of sensitivity was prevented similarly to Examples 5 and 6.

EXAMPLE 8

A blank specimen was prepared in the same manner as in Example 5, except that tartrazine, an anti-irradiation dye, was added to the emulsion. The blank specimen showed a gamma value of 8.3 and a fog density of 0.02, indicating desirable characteristics. However, when the blank specimen was sensitometrically exposed, then, left standing under room-light, and developed, it was found that the sensitivity had declined to 14% of the original value.

Seventeen types of specimens were prepared by incorporating dyes No. 1 to No. 17 (described previously) into the protective layer of the blank specimen at a coverage of 70 mg/m$^2$. Each specimen was tested in the same manner as described above. In all of the cases, the retention of sensitivity was found to be 90% or more, indicating that the decline of sensitivity was mostly prevented.

EXAMPLE 9

A monodisperse emulsion of 0.15 μm in average grain size was prepared by using $5\times10^{-7}$ mole of rhodium chloride per mole of silver chlorobromide containing 98 mole-% of silver chloride. Using the emulsion, specimens were prepared in the same manner as in Example 8, except that combinations of spectrally nonsensitizing dyes and the organic desensitizers shown in Table 3 were used. In Table 3 are shown sensitivities of the specimens after sensitometric exposure and subsequent standing under the room-light for 30 minutes. The sensitivity is expressed in terms of relative value, assuming that the sensitivity of each specimen which was not left standing under the room-light is 100.

TABLE 3

| Organic desensitizer | Dye | Sensitivity |
|---|---|---|
| D-9 | - (Blank) | 11 |
| " | 1 | 95 |
| " | 4 | 94 |
| " | 10 | 95 |
| " | 11 | 93 |
| " | 15 | 97 |
| D-14 | - (Blank) | 14 |
| " | 1 | 96 |

TABLE 3-continued

| Organic desensitizer | Dye | Sensitivity |
|---|---|---|
| " | 4 | 96 |
| " | 10 | 95 |
| " | 11 | 94 |
| " | 15 | 97 |

From the results shown in Table 3, it is seen that organic desensitizers cause marked decline in sensitivity determined after imagewise exposure and subsequent standing under the room-light and that such a decline is mostly prevented by the use of a spectrally nonsensitizing dye.

EXAMPLE 10

A specimen was prepared by providing an emulsion layer containing 20 mg/m$^2$ of dye No. 3, a protective gelatin layer containing 50 mg/m$^2$ of dye No. 3, and a backing gelatin layer containing 60 mg/m$^2$ of dye No. 3. The original emulsion used was the same as that used in the blank specimen of Example 7. The specimen showed a decline of only 5% or less in sensitivity determined after imagewise exposure and subsequent standing under the room-light, indicating an improvement in light stability.

EXAMPLE 11

Various types of specimens were prepared in the same manner as that of preparing the blank specimen of Example 5, except that various compounds of the general formula (A) and reference compounds were added to the emulsion in an amount of 400 mg per mole of silver halide. In Table 4 are shown sensitivities of the specimens after sensitometric exposure and subsequent standing under the room-light for 30 minutes. The sensitivity in Table 4 is expressed in terms of relative value, assuming that the sensitivity of each specimen which was not left standing under the room-light is 100.

TABLE 4

| Compound | Sensitivity | Compound | Sensitivity |
|---|---|---|---|
| (Blank) | 12 | (22) | 97 |
| (1) | 97 | (A) | 22 |
| (3) | 94 | (B) | 28 |
| (4) | 98 | (C) | 25 |
| (6) | 95 | (D) | 9 |
| (7) | 96 | (E) | 8 |
| (8) | 95 | (F) | 5 |
| (9) | 97 | (G) | 8 |
| (12) | 96 | (H) | Fog |
| (15) | 98 | (I) | 20 |
| (16) | 98 | (J) | 4 |
| (18) | 96 | | |

The specimen containing the reference compound (H) showed much fogging before being left under the room-light and the sensitivity determination was impossible. The results shown in Table 4 indicate that the compounds of general formula (A) are capable of satisfactorily preventing the decline in sensitivity of the imagewise exposed specimen caused by the subsequent exposure under the room-light. Specimens containing these compounds also showed no fogging upon exposure under the room-light either before or after the imagewise exposure.

EXAMPLE 12

Specimens were prepared in the same manner as in Example 6, except that thiosalicylic acid compounds were used in place of the compounds of general formula (A). The results obtained were as shown in Table 5.

TABLE 5

| Organic desensitizer | Compound | Sensitivity |
|---|---|---|
| D-2 | (Blank) | 10 |
| " | (1) | 98 |
| " | (11) | 98 |
| " | (19) | 98 |
| " | (21) | 96 |
| D-6 | - (Blank) | 9 |
| " | (1) | 97 |
| " | (11) | 98 |
| " | (19) | 98 |
| " | (21) | 97 |
| D-7 | - (Blank) | 5 |
| " | (1) | 96 |
| " | (11) | 96 |
| " | (19) | 97 |
| " | (21) | 96 |
| D-10 | - (Blank) | 11 |
| " | (1) | 98 |
| " | (11) | 98 |
| " | (19) | 98 |
| " | (21) | 97 |
| D-12 | - (Blank) | 8 |
| " | (1) | 96 |
| " | (11) | 96 |
| " | (19) | 97 |
| " | (21) | 97 |

From the results shown in Table 5, it is seen that organic desensitizers cause marked deline in sensitivity determined after imagewise exposure and subsequent standing under the room-light and that such a decline is satisfactorily prevented by the use of compounds of general formula (A).

EXAMPLE 13

Specimens were prepared in the same manner as in Example 11, except that the compounds of general formula (B) were used. The results obtained were as shown in Table 6.

TABLE 6

| Compound | Sensitivity | Compound | Sensitivity |
|---|---|---|---|
| - (Blank) | 12 | (D) | 9 |
| (26) | 97 | (E) | 8 |
| (29) | 97 | (F) | 4 |
| (32) | 95 | (G) | 8 |
| (A) | 22 | (K) | 10 |
| (B) | 28 | (L) | 13 |
| (C) | 25 | | |

The results shown in Table 6 indicate that the compounds of general formula (B) used according to this invention are capable of satisfactorily preventing the sensitivity of the imagewise exposed specimen from the decline caused by the subsequent exposure to the room-light.

EXAMPLE 14

The procedure of Example 11 was repeated, except that compounds of the general formula (C) or (D) were used. The results obtained were as shown in Table 7.

TABLE 7

| Compound | Sensitivity | Compound | Sensitivity |
|---|---|---|---|
| - (Blank) | 12 | (B) | 28 |
| (34) | 98 | (C) | 25 |
| (35) | 97 | (D) | 9 |
| (36) | 94 | (E) | 8 |
| (37) | 97 | (F) | 5 |

TABLE 7-continued

| Compound | Sensitivity | Compound | Sensitivity |
|---|---|---|---|
| (39) | 98 | (G) | 8 |
| (42) | 90 | (L) | 7 |
| (45) | 98 | (I) | 20 |
| (A) | 22 | (J) | 4 |

The results shown in Table 7 tell that the compounds used according to this invention are capable of satisfactorily preventing the sensitivity of the imagewise exposed specimen from the decline due to the subsequent exposure to the room-light.

What is claimed is:

1. A silver halide photographic photosensitive material which comprises a support and photographic layers including at least one silver halide emulsion layer which contains (1) a spectrally unsensitized negative silver halide having an average grain size of 0.1 to 0.3 μm and containing at least 80 mol % of silver chloride and (2) an organic desensitizer having an anodic polargraphic potential and a cathodic polargraphic potential which give a positive sum, wherein said emulsion has undergone substantially no chemical ripening and wherein said photosensitive material contains:

(c) (iv) 2-mercaptobenzoic acids.

2. A silver halide photographic photosensitive material according to claim 1 wherein the amount of the compound - (iv) is about 20 mg to about 5 g per mole of silver halide.

3. A silver halide photographic photosensitive material according to claim 1 wherein the silver halide of the silver halide emulsion layer contains at least 90 mol % of silver chloride.

4. A silver halide photographic sensitive material as in claim 1, wherein said photosensitive material contains 2-mercaptobenzoic acid.

* * * * *